United States Patent [19]

Combs

[11] Patent Number: 4,903,836

[45] Date of Patent: Feb. 27, 1990

[54] CARTON FOR TWIN TUBE FLUORESCENT LAMP

[75] Inventor: Kenneth Combs, Warrensville Heights, Ohio

[73] Assignee: General Electric Company, Schenectady, N.Y.

[21] Appl. No.: 322,584

[22] Filed: Mar. 13, 1989

[51] Int. Cl.[4] ..... B65D 85/42

[52] U.S. Cl. ..... 206/419; 220/2.1 R; 229/120.77; 206/418

[58] Field of Search ..... 206/419, 422, 418; 220/2.1 R; 229/120.17, 120.18, 120.21

[56] References Cited

U.S. PATENT DOCUMENTS

| | | | |
|---|---|---|---|
| 2,825,496 | 3/1958 | Miessler Sr. | 206/422 |
| 2,854,181 | 2/1954 | Smith | 229/120.18 |
| 3,326,369 | 6/1967 | Tolaas et al. | 206/608 |
| 3,734,397 | 5/1973 | Cote | 229/39 B |
| 4,200,192 | 4/1980 | Klomp | 206/418 |
| 4,441,650 | 4/1984 | Caldwell et al. | 229/39 B |
| 4,561,542 | 12/1985 | Przepiora et al. | 206/418 |
| 4,717,022 | 1/1988 | Combs | 206/418 |
| 4,773,539 | 9/1988 | Nock | 206/418 |

*Primary Examiner*—Stephen Marcus
*Assistant Examiner*—Jacob Ackun, Jr.
*Attorney, Agent, or Firm*—Edward M. Corcoran; Stanley C. Corwin; Fred Jacob

[57] ABSTRACT

A paperboard carton for simultaneously protecting and displaying a twin tube or U-tube type of fluorescent lamp which comprises a rectangular sleeve having a panel which fits into the longitudinal space separating the leg members, between the base of the lamp and the transverse member, to hold the lamp in place in the carton.

24 Claims, 3 Drawing Sheets

CARTON FOR TWIN TUBE FLUORESCENT LAMP

BACKGROUND OF THE INVENTION

Field of the Invention

The present invention relates to a carton for twin tube types of fluorescent lamps. More particularly, the present invention relates to a paperboard carton for twin tube or U-tube types of fluorescent lamps, said carton comprising a rectangular sleeve having a panel which fits into the longitudinal space separating the two tubes between the base of the lamp and the transverse member connecting the two tubes, thereby locking the lamp in the carton.

A variety of boxboard or cardboard cartons have been designed and used to protect various types of electric lamps. The well-known and familiar household incandescent and fluorescent lamps are usually packaged in an inexpensive paper carton. More expensive lamps and lamps of unusual shapes and sizes have required the use of packages that will protect the lamp and, preferably, also serve to display at least a portion of the lamp. Examples of such cartons may be found, for example, in U.S. Pat. Nos. 3,734,397; 4,200,192; 4,561,542 and 4,717,022. A relatively new type of fluorescent electric lamp, a twin tube or U-tube type of lamp, has recently found commercial acceptance. In general these lamps comprise two parallel leg members longitudinally extending from a base at one end, having a predetermined spacing therebetween and joined together at a point along their length by a transverse member spaced apart from said base. The transverse member forms an integral part of the twin tube structure either at the end of the lamp opposite that of the base, or at a point near to the end of the lamp opposite that of the base. Lamps such as these are illustrated, for example, in U.S. Pat. Nos. 4,298,822; 4,481,442; 4,720,656 and 4,786,841, the disclosures of which are incorporated herein by reference. Accordingly, a carton for protecting these types of lamps during handling and shipping, and preferably one which will contain only one lamp for purposes of sales and also display at least a portion of the lamp, is needed.

SUMMARY OF THE INVENTION

The present invention relates to a carton for a twin tube type of fluorescent lamp, which lamp comprises two spaced apart and parallel tube or leg members having a predetermined spacing therebetween longitudinally extending from a base and connected at a point along their length by a transverse member spaced apart from said base, said carton comprising a rectangular sleeve having a first front panel, first and second side panels, a rear panel, a second front panel and a locking panel and wherein said panels are hingedly connected along generally parallel fold lines. The surface of the said locking panel is generally parallel to the side panels and perpendicular to both of the front and rear panels. The locking panel is of a length and thickness so as to enable it to fit into the longitudinal space separating the leg members, between the base of the lamp and the transverse member connecting the legs. The second front panel is connected to the locking panel. The carton of the present invention is formed from a unitary blank adapted to be formed into the rectangular shaped carton for containing the twin tube type of fluorescent lamp, said blank comprising a series of six consecutively arranged, rectangular shaped panels hingedly connected along parallel fold lines, said series comprising:

a first and a third panel for forming a front and a back, respectively, of said carton;

a second and a fourth panel for forming parallel and opposing sides of said carton, said second panel also connecting said first and third panels;

a fifth panel connected to said fourth panel for forming a partial front panel, and a sixth panel depending from and connected to said fifth panel having a length sufficient to fit into the said longitudinal space separating said leg members of said lamp between said base and said transverse member for locking said lamp in the assembled carton.

BRIEF DESCRIPTION OF THE DRAWINGS

FIG. 1(*b*) is a cross-sectional schematic view taken along 1(*b*)—1(*b*) of FIG. 1(*a*).

DETAILED DESCRIPTION

Figure 1A:
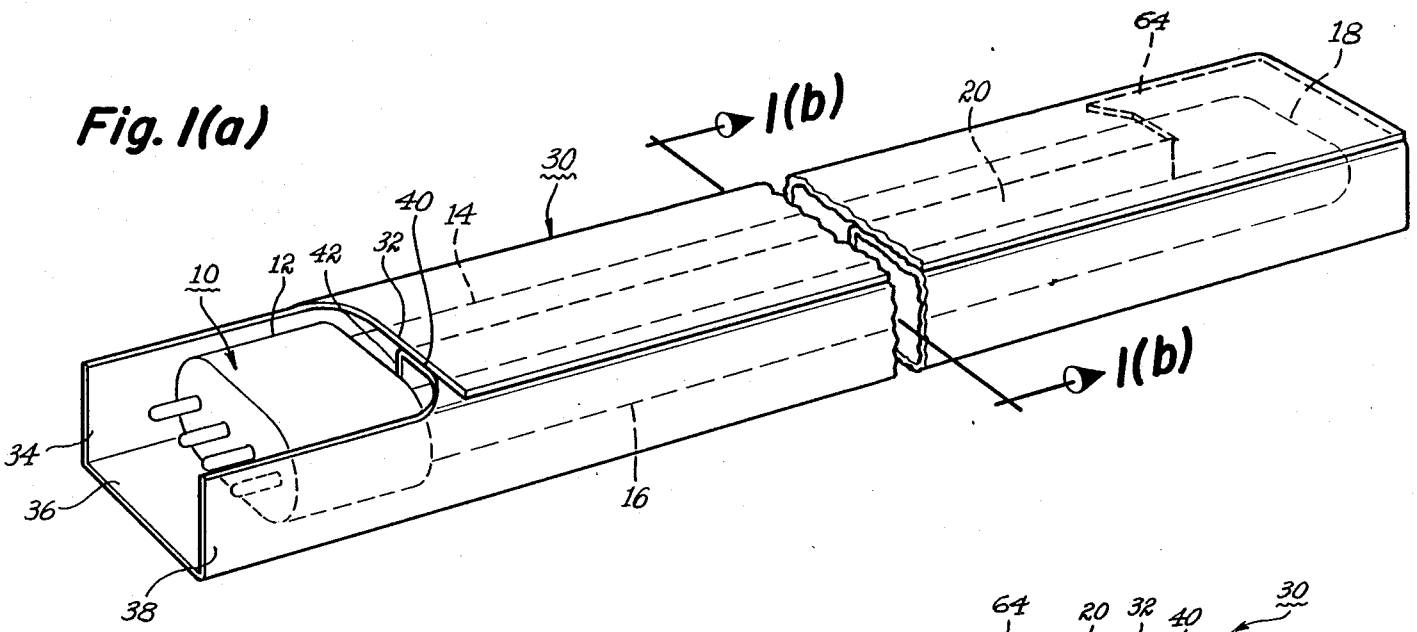
FIG. 1(*a*) is a schematic pictorial view illustrating a carton of the present invention enclosing a twin tube type of fluorescent lamp and displaying a portion of the lamp base.
Figure 1B:
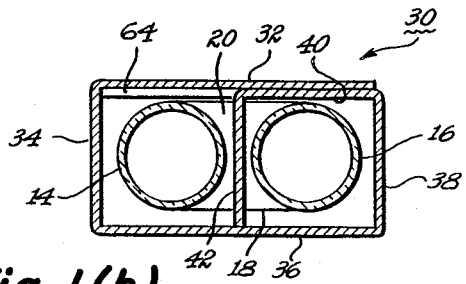

Turning first to FIG. 1, lamp 10 comprising base 12 having fluorescent tube leg members 14 and 16 connected thereto and depending therefrom and connected at their other end by transverse member 18, with a predetermined spacing, space 20, between said leg members is contained within carton 30. Carton 30 is made of six rectangular shaped panels hingedly connected along generally parallel fold lines. Thus, carton 30 is made up of first front wall panel 32 hingedly connected to first side wall panel 34, with side wall panel 34 being connected to back panel 36. Panel 36 in turn is hingedly connected to second side panel 38 which, in turn, is hingedly connected to second front panel 40. Locking panel 42 is hingedly connected to and depends from front panel 40. When assembled into carton 30, panel 42 is folded along fold line 62 (FIG. 2) to depend perpendicularly from second front panel 40 and will be generally parallel to side panels 34 and 38. Locking panel 42 fits in space 20 between leg members 14 and 16 of lamp 10, between base 12 and transverse member 18, thereby locking lamp 10 in carton 30 when the carton is assembled. First front panel 32 is attached to second front panel 40 by suitable means such as an adhesive. Alternatively, one or more straps or other fastening means may be employed to secure carton 30 in its assembled form around lamp 10.

Carton 30 is shown in FIG. 1(*a*) with front panels 32 and 40 of a length less than that of back panel 36 and side panels 34 and 38, so as to display base 12 of lamp 10. Base 12 generally has graphics printed on it containing the name of the lamp manufacturer, the wattage of the lamp, etc. Thus, in the embodiment illustrated in FIG. 1(*a*), carton 30 serves to protect the lamp and to display at least a portion of the base of the lamp. However, the carton of the invention is not intended to be limited by the embodiment illustrated in FIG. 1(*a*). Thus, front panel 32 could be long enough to partially or completely cover base 12 of lamp 10. Alternatively, one or more of panels 34, 36 and 38 could be of a length so as to partially or completely display lamp base 12, etc. This will be understood by those skilled in the art once they have studied the invention.

Figure 2:
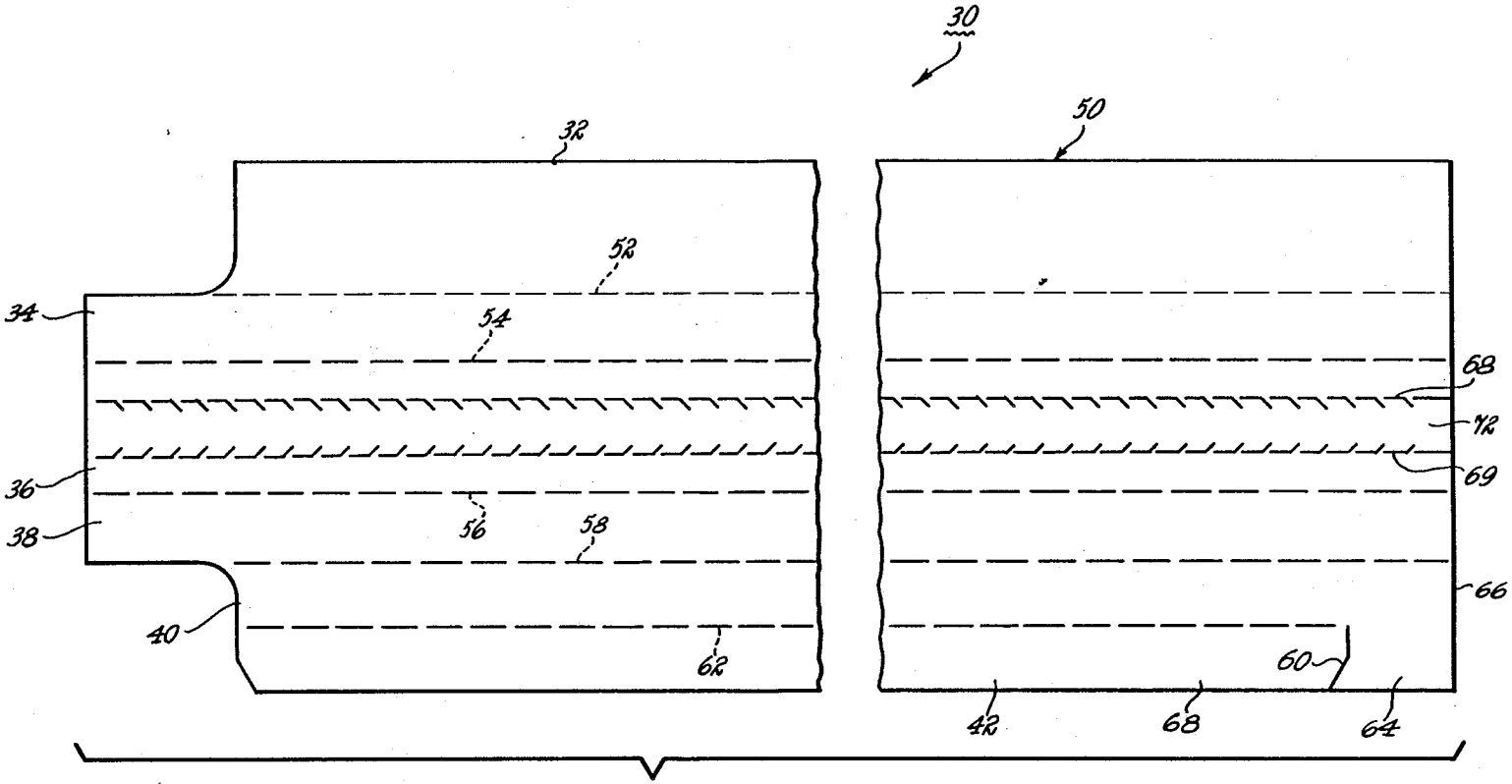
FIG. 2 is a schematic plan view of a boxboard blank from which the carton illustrated in FIG. 1 is constructed.
Figure 3:
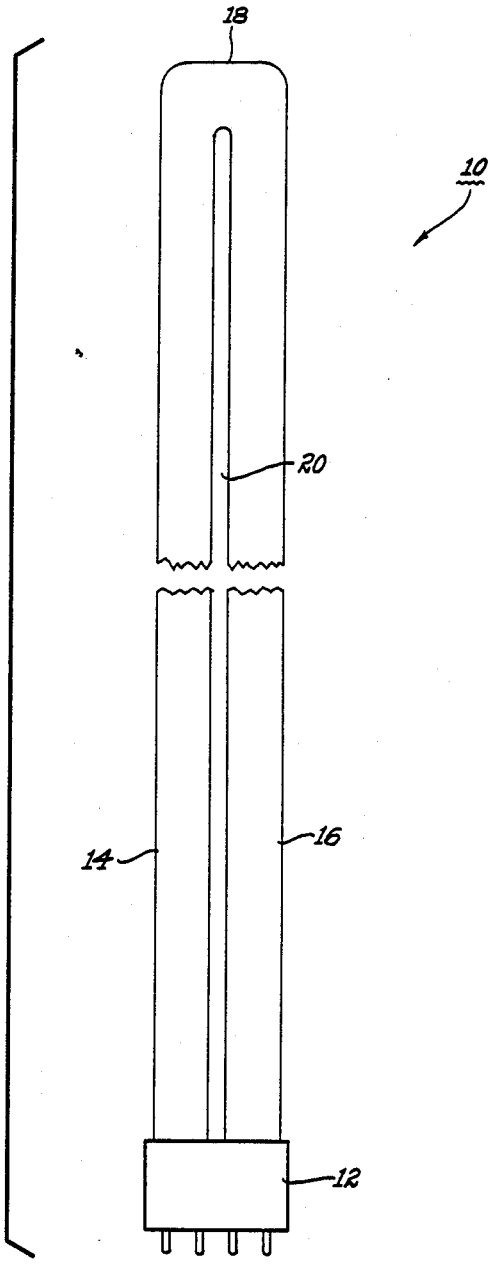
FIG. 3 schematically illustrates a twin tube type of fluorescent lamp with which the present invention is useful.

Turning now to FIG. 2, blank 50 from which carton 30 is formed is a unitary blank comprising a series of six consecutively arranged, rectangular shaped panels, hingedly connected along parallel fold lines. The series comprises panel 32 for forming the first front panel of carton 30. Panel 32 is hingedly connected along fold line 52 to first side panel 34. First side panel 34 is hingedly connected along fold line 54 to back panel 36 which, in turn, is connected along fold line 56 to second side panel 38. Side panel 38 is hingedly connected along fold line 58 to front panel 40. A portion of front panel 40 is formed into locking panel 42 by means of fold line 62 and cut 60. Accordingly, cut 60 extends from fold line 62 to the end 68 of locking panel 42 to enable panel 42 to be folded along said fold line 62 to form said locking panel. In this embodiment, area 64 is a part of front panel 40 and, as shown in FIG. 1, extends completely across the front of fluorescent tube legs 14 and 16 and transverse member 18, when blank 50 is formed into carton 30 and contains lamp 10. This is a preferred embodiment of the invention, because it enables better closure of top panel 32 over top panel 40 without distortion of the carton at that portion of the sides of the carton in the vicinity of transverse member 18. Thus, this embodiment ensures that sides 34 and 38 will be parallel. However, those skilled in the art will appreciate that panel 42 can extend all the way to end 66 of blank 50 with a suitably shaped and located U-shaped or square-shaped cutout 70 in place of separation or cut line 60, in order to accommodate transverse member 18 when the carton is formed. It will also be appreciated by those skilled in the art that panels 34 and 38 will be of equal width which will be smaller than the width of panel 32. Further, as a practical matter, the combined width of panels 40 and 42 will be about equal to the width of panel 32.

In a further embodiment of the present invention, back panel 36 will have a tear-out portion or strip 72 formed by two lines of perforations 68 and 69 generally parallel both to each other and to fold lines 54 and 56, with the distance between said perforations 68 and 69 determined by the width of tear-out portion 72 desired. In this embodiment, when the carton is assembled and encloses and displays a lamp therein with front panel 32 glued to front panel 40, the carton may be facilely removed from the lamp merely by removing tear-out portion 72.

What is claimed is:

1. A carton for a twin tube type of fluorescent lamp which lamp comprises two spaced apart and parallel tube or leg members having a predetermined spacing therebetween and longitudinally extending from a base to which they are connected at one end and connected at a point along their length by a transverse member spaced apart from said base, said carton comprising a rectangular sleeve having a first front panel, first and second side panels, a rear panel, a second front panel and a locking panel, wherein said panels are hingedly connected along generally parallel fold lines, with the surface of said locking panel generally parallel to said side panels and perpendicular to said front and rear panels, wherein said locking panel is of a length and thickness so as to enable it to fit into said longitudinal space separating said leg members, between said base and said transverse member, wherein said second front panel connects said locking panel to said second side panel and wherein a portion of said second front panel extends across the width of said lamp.

2. The carton of claim 1 wherein said rear panel contains a tear-out strip formed by two lines of perforations extending longitudinally along the length of said rear panel.

3. The carton of claim 1 wherein said extension of said second front panel is in the vicinity of said transverse member of said lamp.

4. The carton of claim 3 wherein said rear panel contains a tear-out strip formed by two lines of perforations extending longitudinally along the length of said rear panel.

5. The carton of claim 4 wherein the length of said first and second front panels is short enough to expose at least a portion of said lamp base.

6. A unitary bank adapted to be formed into a rectangular shaped carton for containing a twin tube type of fluorescent lamp having two leg members longitudinally extending from a base, said blank comprising a series of six consecutively arranged, rectangular shaped panels hingedly connected along parallel fold lines, said series comprising:

a first and a third panel for forming a front and a back, respectively, of said carton;

a second and a fourth panel for forming parallel and opposing sides of said carton, said second panel also connecting said first and third panels;

a fifth panel connected to said fourth panel for forming a partial front panel, and a sixth panel depending from and connected to said fifth panel for locking said lamp in said carton wherein a portion of said fifth panel extends laterally beyond one end of said fold line between said fifth and sixth panels.

7. The blank of claim 6 wherein said rear panel contains a tear-out strip formed by two lines of perforations extending longitudinally along the length of said rear panel.

8. The blank of claim 6 wherein said extension of said fifth panel is at that portion of the blank which, when assembled is at that end thereof opposite said lamp base.

9. The blank of claim 8 wherein said third panel contains a tear-out strip formed by two lines of perforations extending longitudinally along the length of said rear panel.

10. The blank of claim 8 wherein the length of said first and fifth panels is short enough to expose at least a portion of said lamp base when said blank is formed into a carton.

11. The blank of claim 9 wherein at least a portion of said fifth panel serves as a glue flap for gluing to at least a portion of said first panel to said fifth panel.

12. The carton of claim 1 wherein the length of said first and second front panels is short enough to expose at least a portion of said lamp base.

13. The carton of claim 2 wherein the length of said first and second front panels is short enough to expose at least a portion of said lamp base.

14. The carton of claim 3 wherein the length of said first and second front panels is short enough to expose at least a portion of said lamp base.

15. The blank of claim 6 wherein the length of said first and fifth panels is short enough to expose at least a portion of said lamp base when said blank is formed into a carton.

16. The blank of claim 7 wherein the length of said first and fifth panels is short enough to expose at least a portion of said lamp base when said blank is formed into a carton.

17. The blank of claim 8 wherein the length of said first and fifth panels is short enough to expose at least a portion of said lamp base when said blank is formed into a carton.

18. In combination, a carton containing a twin tube type of fluorescent lamp which comprises two spaced apart and parallel tube or leg members having a predetermined spacing therebetween and longitudinally extending from a base to which they are connected at one end and connected at a point along their length by a transverse member spaced apart from said base, said carton consisting essentially of a rectangular sleeve made of six consecutively arranged, rectangular shaped panels hingedly connected along parallel fold lines and including a first front panel connected to a first side wall panel, said first side wall panel connected to a back panel which, in turn, is connected to a second side wall panel which, in turn, is connected to a second front panel and a locking panel hingedly connected to and depending from said second front panel, wherein said locking panel is of a length and thickness so as to enable it to fit into said longitudinal space between said leg members between said base and said transverse member thereby locking said lamp in said carton and wherein a portion of said second front panel extends laterally beyond an end of said fold line from which said locking panel depends.

19. The combination of claim 18 wherein said lateral extension of said second front panel extends substantially across the width of said lamp.

20. The combination of claim 19 wherein said lateral extension of said second front panel panel is in the vicinity of said transverse member of said lamp.

21. The combination of claim 18 wherein the length of said first and second front panels is short enough to expose at least a portion of said lamp base.

22. The combination of claim 21 wherein said rear panel contains a tear-out strip formed by two lines of perforations extending longitudinally along the length of said rear panels.

23. The combination of claim 20 wherein the length of said first and second front panels is short enough to expose at least a portion of said lamp base.

24. The combination of claim 23 wherein said rear panel contains a tear-out strip formed by two lines of perforations extending longitudinally along the length of said rear panels.

* * * * *